United States Patent [19]

Nakai

[11] Patent Number: 4,750,342

[45] Date of Patent: Jun. 14, 1988

[54] LOCKING DEVICE RESISTANT TO FORCIBLE OPENING

[75] Inventor: Hatsuo Nakai, Toyonaka, Japan

[73] Assignee: Clover Co., Ltd., Osaka, Japan

[21] Appl. No.: 96,230

[22] Filed: Sep. 4, 1987

Related U.S. Application Data

[63] Continuation of Ser. No. 869,752, Jun. 2, 1986, abandoned.

[30] Foreign Application Priority Data

Feb. 19, 1986 [JP] Japan ..... 61-36133

[51] Int. Cl.[4] ..... E05B 29/04

[52] U.S. Cl. ..... 70/364 R; 70/377

[58] Field of Search ..... 70/364 R, 364 A, 376, 70/377, 419

[56] References Cited

U.S. PATENT DOCUMENTS

| | | | |
|---|---|---|---|
| 167,088 | 8/1875 | Felter | 70/364 R |
| 2,003,086 | 5/1935 | Liss | 70/364 R |
| 2,024,441 | 12/1935 | Fitzgerald | 70/362 |
| 2,405,911 | 8/1946 | Swanson | 70/364 R |
| 2,460,551 | 2/1949 | Swanson | 70/364 R |
| 2,729,092 | 1/1956 | Taylor | 70/364 R |
| 3,035,433 | 5/1962 | Testa | 70/364 R |
| 3,709,006 | 1/1973 | Seidewand | 70/364 R |
| 3,722,241 | 3/1973 | Sussina | 70/364 R |
| 4,081,147 | 7/1979 | Taylor | 70/364 R |
| 4,376,382 | 3/1983 | Raymond | 70/354 R |

*Primary Examiner*—Robert L. Wolfe

*Attorney, Agent, or Firm*—Jordan and Hamburg

[57] ABSTRACT

A locking device comprises an outer cylinder provided with a clutch bar engaging groove extending longitudinally along its inner surface, an inner cylinder contained and arranged within the outer cylinder, a clutch bar arranged between the outer and inner cylinders for removable engagement with the aforementioned engaging groove at one side and a plurality of discs within the inner cylinder and arranged reciprocally in the orthogonal direction to the clutch bar. Each of the discs is provided with a slit-shaped key hole, on the corner portion of which projections having depths and inclined angles conforming to inclined notches of a key are formed. On each disc, by cutting one side thereof, there is also formed a recess removably engaging the other side of the clutch bar, and a spring is connected to the other side of each disc to bias the recess in a direction of non-alignment with the position of the clutch bar.

7 Claims, 9 Drawing Sheets

LOCKING DEVICE RESISTANT TO FORCIBLE OPENING

This application is a continuation of application Ser. No. 869,752, filed June 2, 1986 and now abandoned.

BACKGROUND OF THE INVENTION

1. Field of the Invention

The present invention relates to a locking device applicable to cash handling machines, for example, such as an automatic vending machine, a gaming machine, an automatic cash dispenser, a money exchanger and the like.

Conventionally, there are two known types of such locking device, one type being a pin tumbler having a reciprocating motion and the other being a disc tumbler having a sliding motion.

In the former type locking device, a plurality of pin tumblers are arranged longitudinally within an inner cylinder at equal intervals and a spring is interposed between the outer and inner cylinders to engage the upper portion of each pin tumbler to the outer cylinder and the lower portion to the inner cylinder. It is so arranged that, as a key is inserted into a key hole of the locking device, the lower portion of each pin tumbler retreats all together to the outer cylinder, thereby releasing the locked condition.

In such a lock construction, however, because a spring must be provided at each pin tumbler, it is not only troublesome to assemble, but the locking device itself is required have to be large because of the increased adjacent spaces between the pin tumblers. Thus the number of key settings is limited.

In the latter type locking device, it is so arranged that a plurality of disc tumblers are mounted in the inner cylinder and as each disc tumbler is slid by the set amount by the operation of the key, all the disc tumblers will be contained within the inner cylinder in alignment, thereby releasing the engagement with the notch in the outer cylinder and allowing the inner cylinder to rotate.

In such a lock construction, however, the strength of the disc tumbler is weakened by the key hole opened in the center of the plate thereof. Thus when a strong external force is applied to the disc tumbler engaging the outer cylinder, there is a possibility that the disc tumbler may be crushed and destroyed, resulting in a violently forcible unlocking.

SUMMARY OF THE INVENTION

A locking device of the present invention comprises an outer cylinder provided with a clutch bar engaging groove longitudinally along the inner surface, an inner cylinder contained and arranged within the outer cylinder, a clutch bar disposed between the outer and inner cylinders and removably engageable with the aforementioned engaging groove at one side portion and a plurality of discs disposed longitudinally within the inner cylinder and arranged in a freely reciprocating fashion in an orthogonal direction to the clutch bar.

Each disc is provided with a slit-shaped key hole, on the corner portion of which a projection having an and inclined angle conforming to inclined notches of a key are formed.

On each disc, by cutting one side thereof, there is also formed a recess to which the other side portion of the clutch bar is engaged removably and further on the other side of each disc, a spring is engaged to bias the disc in a direction shifting from the position in which the clutch bar engaged in the recess.

It is therefore an object of the present invention to provide a compact and high-precision locking device which ensures various key settings and makes the violently forcible unlocking practically impossibly.

The above and other objects, features and effects of the present inventiion will become more apparent from the following description when taken in conjunction with the accompanying drawings.

DETAILED DESCRIPTION OF THE PREFERRED EMBODIMENTS

Figure 1:
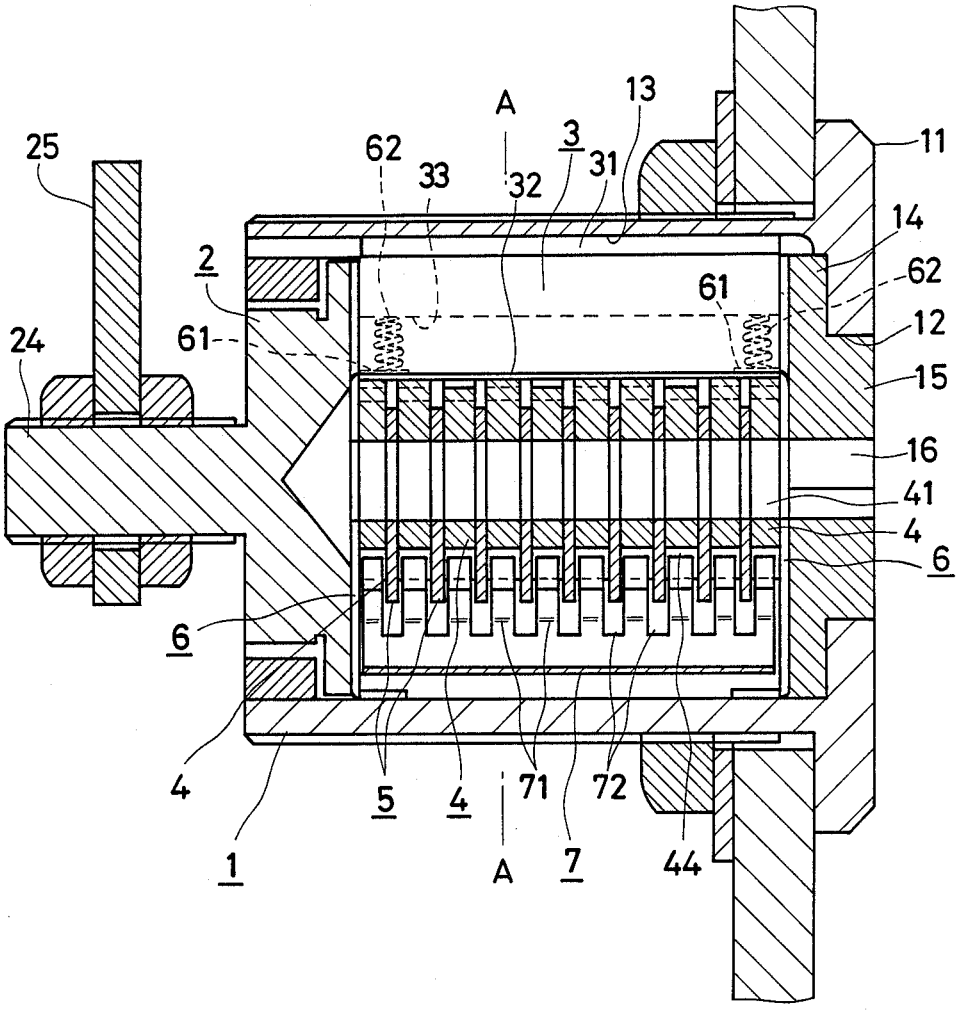
FIG. 1 is a cross-sectional view of a locking device in accordance with the present invention.
Figure 2:
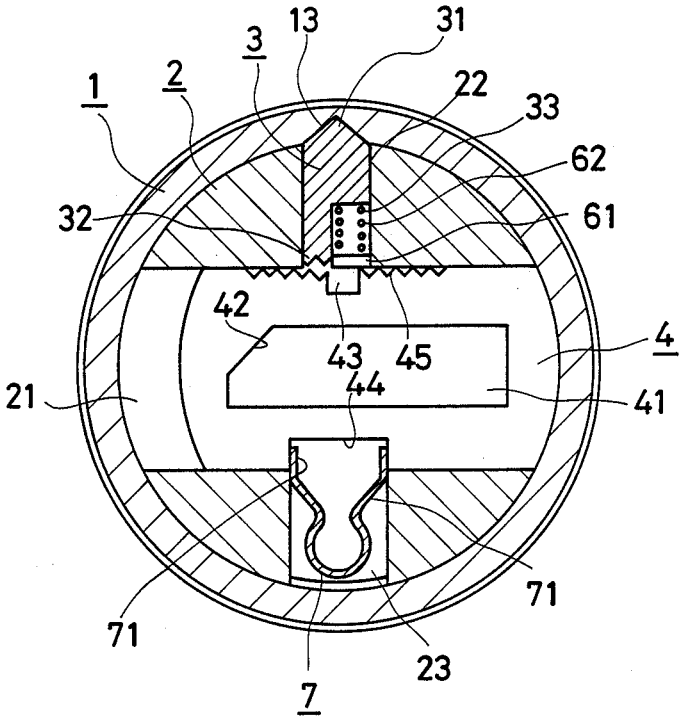
FIG. 2 is a cross-sectional view taken along the line A—A of FIG. 1.
Figure 3:
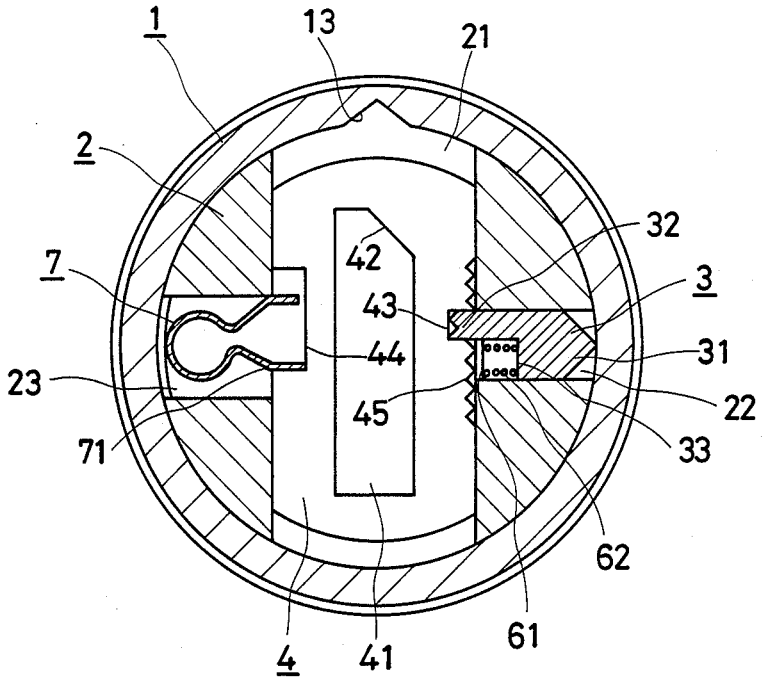
FIG. 3 is a cross-sectional view showing an actuating condition of a locking device.

FIGS. 1 and 2 illustrate a locking device in accordance with one embodiment of the present invention.

The locking device shown in the drawing comprises an outer cylinder 1 forming a lock body, an inner cylinder 2 contained and arranged rotatably within the outer cylinder 1, a clutch bar 3 disposed between the outer and inner cylinders 1 and 2, which extends and retracts relative to a border line (called a shear line) therebetween to couple or release the two cylinders together and a plurality of discs 4 disposed and arranged longitudinally within the inner cylinder 2 for restricting the movement of the clutch bar 3.

The aforementioned outer cylinder 1 is of a cylindrical shape with an opened rear face. A circular hole 12 is opened in a face plate 11. A V-shaped clutch bar engaging groove 13 is provided on its inner surface extending longitudinally.

A guard plate 14 and the inner cylinder 2 are inserted into the outer cylinder 1 from the rear opening.

Figure 4:
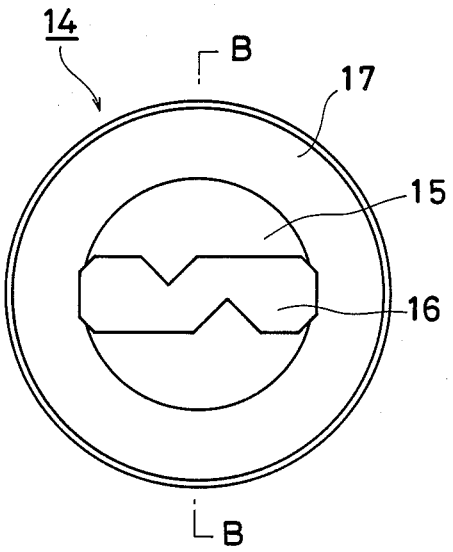
FIG. 4 is a front view of a guard plate.
Figure 5:
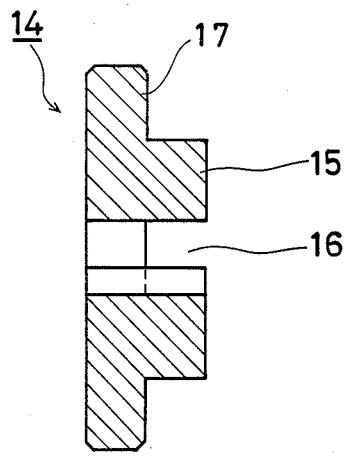
FIG. 5 is a cross-sectional view taken along the line B—B of FIG. 4.

On the guard plate 14, as shown in FIGS. 4 and 5, a circular boss 15 is disposed integrally on one side of a circular base plate 17, in the center of which including the boss 15, a key hole 16 is opened for alignment with the key. The guard plate 14 is positioned between the front end of the inner cylinder 2 and the face plate 11, the boss 15 being engaged to the circular hole 12 in the face plate 11.

Figure 6:
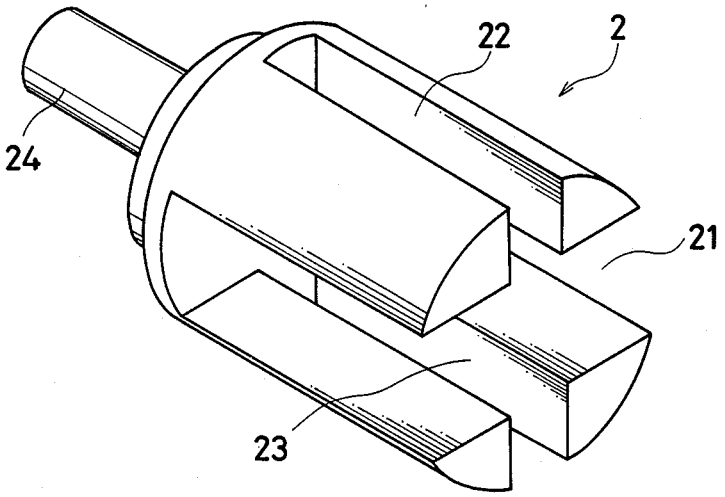
FIG. 6 is a perspective view of an inner cylinder.
Figure 9:
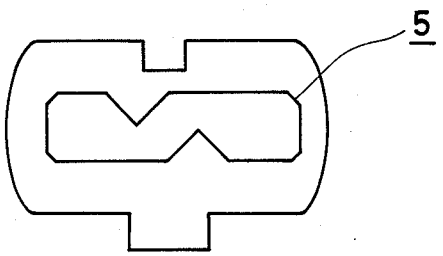
FIG. 9 is a front view of a retainer.

The inner cylinder 2 has a diameter conforming to the inside diameter of the outer cylinder 1, and comprises, as shown in FIG. 6, a disc mounting portion 21 communicating diametrically along a longitudinal direction of the cylinder, a clutch bar engaging portion 22 communicating orthogonally to the disc mounting portion 21 and having a width coinciding with that of the opening of the engaging groove 13 in the aforementioned outer cylinder 1 and a spring mounting portion 23. A mounting shaft 24 is projected integrally at the rear end of the inner cylinder 2 to support a dead bolt 25. On the clutch bar engaging portion 22 of the inner cylinder 2 and on the disc mounting portion 21, the clutch bar 3 and a plurality of disc retainers 5 having a shape shown in FIG. 9 are respectively arranged, and in the spring mounting portion 23 a return spring 7 for biasing each disc 4 in a first position is engaged.

The aforementioned clutch bar 3 includes a V-shaped actuating portion 31 on the outer side engageable with the outer cylinder 1 and on the inner side engageable with the discs 4. A actuating portion 32 is provided with a step 33 on the side thereof to reduce its width. While the actuating portion 31 engages the clutch bar engaging groove 13 in the outer cylinder 1, the other actuating portion 32 engages the recess 43 as well be explained later responsive to the position of each disc 4.

On end retainers 6, there are formed bent fixing pieces 61, which are engaged with the step 33 of the clutch bar 3 to arrange springs 62 therebetween for biasing the clutch bar 3 to the clutch bar engaging groove 13 in the outer cylinder 1.

Figure 7:
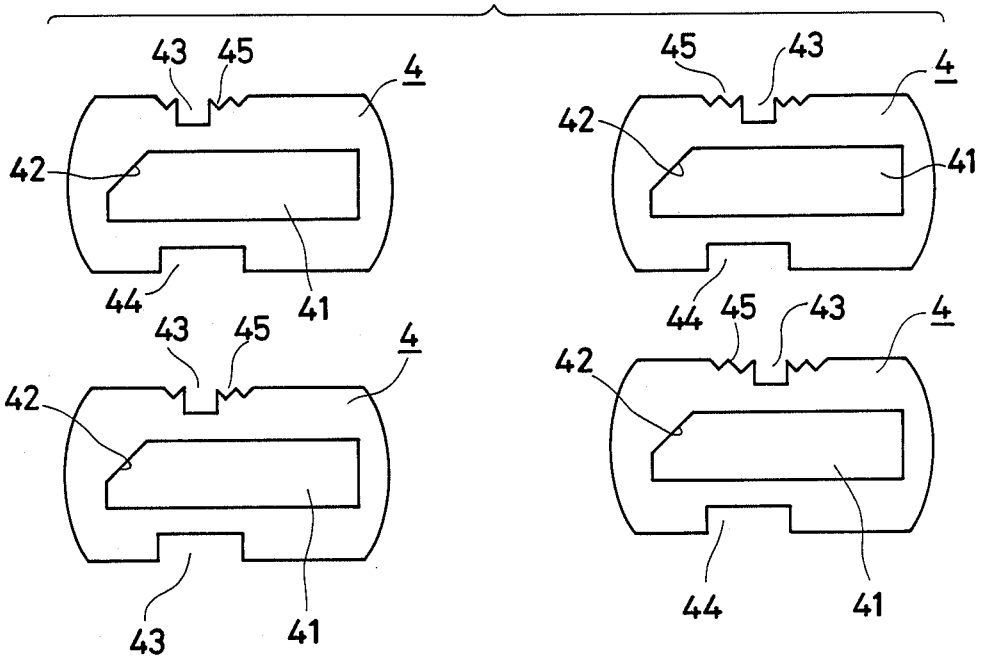
FIG. 7 is a front view of a disc.

Each of the aforementioned discs 4 is formed as a stamped metal plate having a width conforming to the disc mounting portion 21 of the inner cylinder 1 and a length shorter than the diameter of the inner cylinder by the sliding distance and is respectively arranged reciprocally in the disc mounting portion 21 orthogonally to the clutch bar 3. On the surface of each disc 4, as shown in FIG. 7, a slit-shaped key hole 41 coinciding with the section of the key axis is provided and projection 42 having a depth and inclined angle conforming to the corresponding inclined notch of the inserted key is formed on one corner of the key hole 41. On the side of each disc 4 opposing the clutch bar 3, a recess 43 is formed and its position is shifted in the direction of the key hole, responsive to the depth of the projection 42, for engagement with the actuating piece 32 of the clutch bar 3. A plurality of saw-tooth portions 45 are formed on the side of the recess 43. On the opposite side of each disc 4, there is formed another recess 44 engaging both spring ends 71 of the U-shaped return spring 7 which is disposed in the spring mounting portion 23 of the inner cylinder 2. The discs 4 are biased in the direction shifting the aforementioned recess 43 away from the clutch bar 3.

Figure 8:
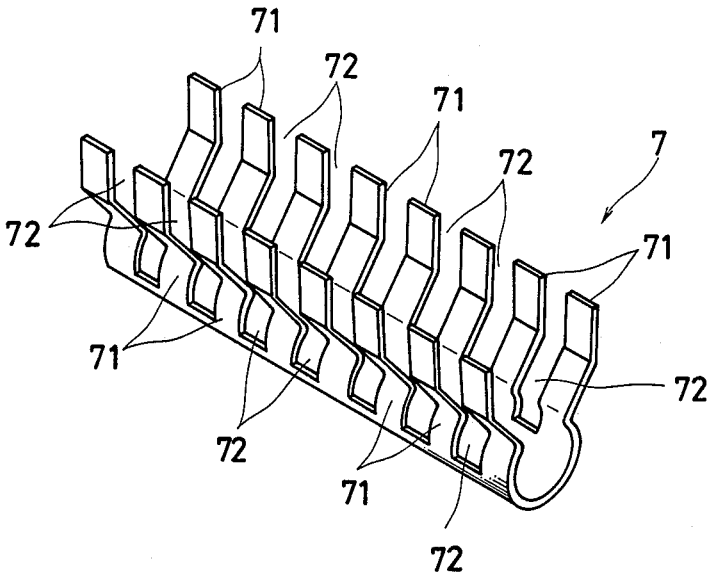
FIG. 8 is a perspective view of a spring.

The return spring 7 is, as shown in FIG. 8, formed by bending a spring plate of a U-shaped construction to provide engaging channels 72 for the retainers 5 on the opposing walls and to form a series of spring ends 71 opposing each other between the adjacent channels 72. The return spring 7 is engaged to and supported by the spring mounting portion 23 of the inner cylinder 2 and the ends 71 of the spring engage the corresponding recess 44 of each disc 4.

Figure 10:
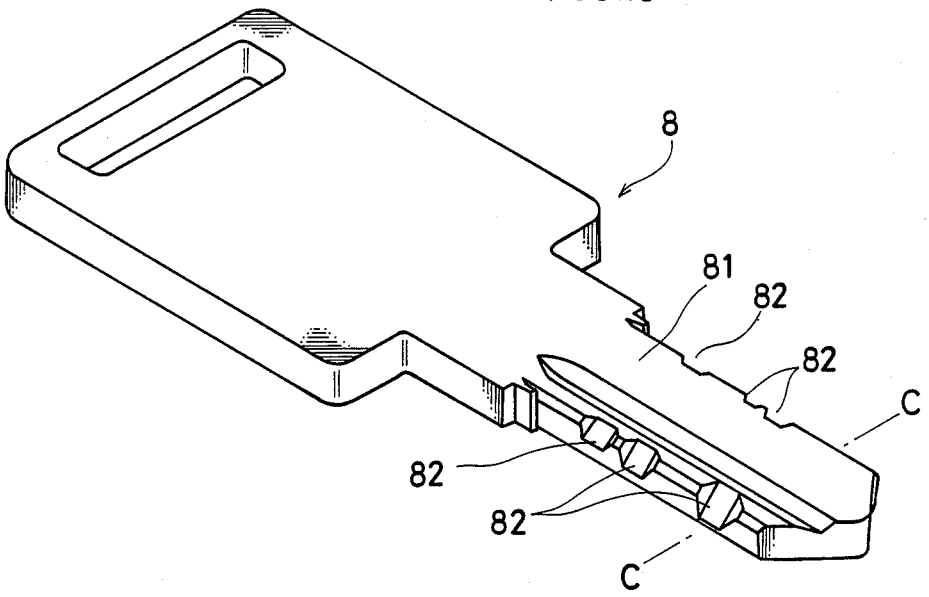
FIG. 10 is a perspective view of a key used in a locking device in accordance with the present invention.
Figure 11:
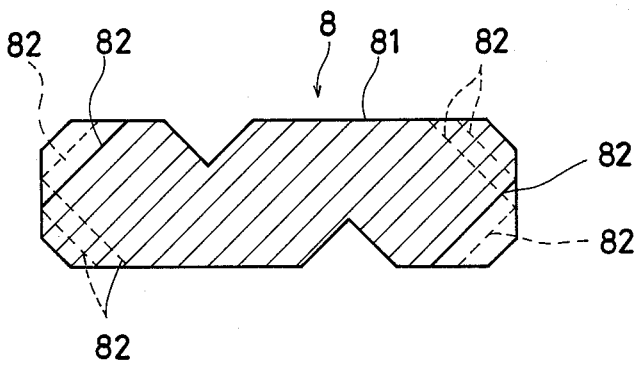
FIG. 11 is a cross-section view taken along the line C—C of FIG. 10.

FIGS. 10 and 11 illustrate one example of a key 8 used in the locking device mentioned above. The key 8 shown in the drawing includes a key piece 81 having an axial section conforming to the key hole 16 in the aforementioned guard plate 14 and the key holes 41 of each disc 4. Inclined notches 82 are formed alternately on the upper and lower portions on the diagonally located corner portions of the key 81, each notch 82 being dissimilar in depth and adaptive to the corresponding projection 42 of the disc 4.

Figure 12:
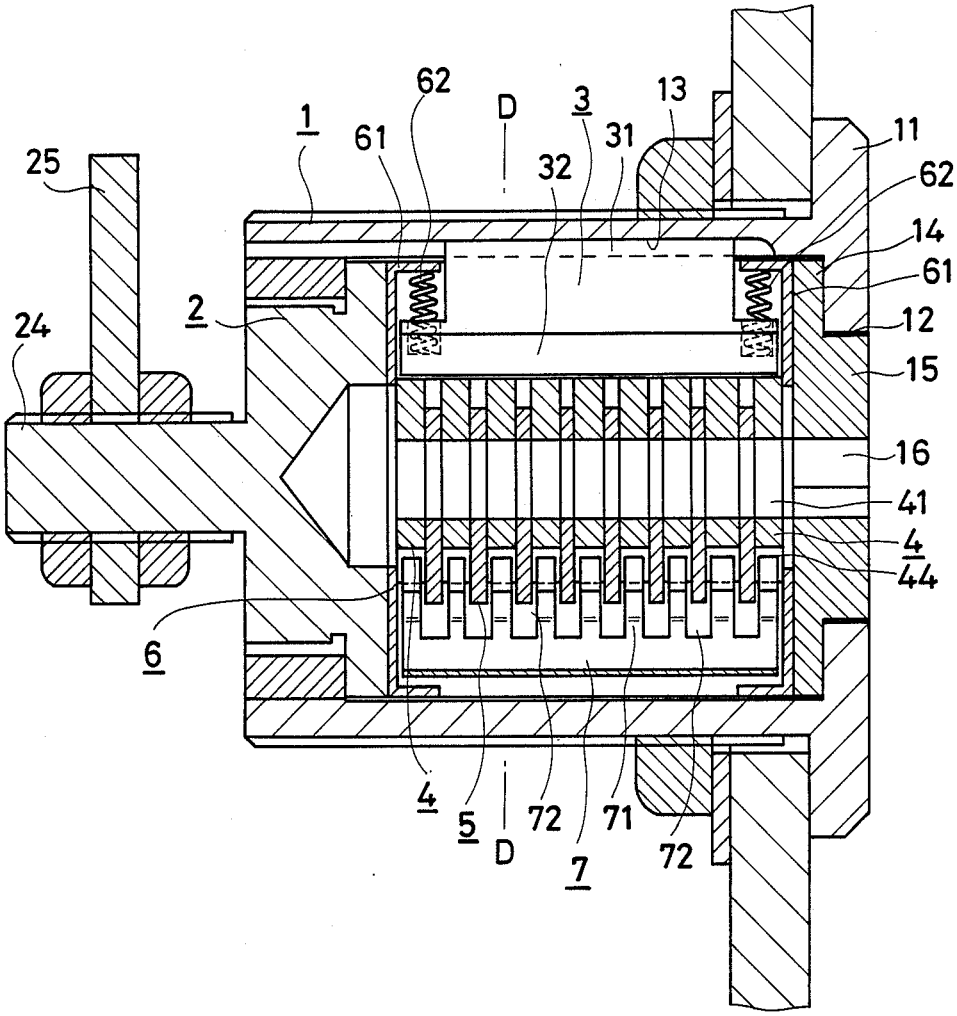
FIG. 12 is a cross-sectional view of a locking device of another embodiment in accordance with the present invention.
Figure 13:
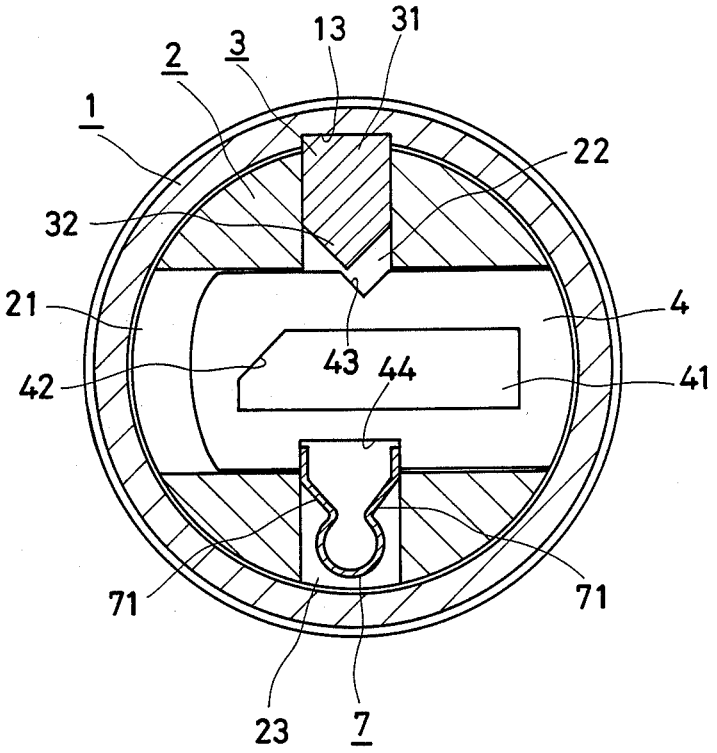
FIG. 13 is a cross-sectional view taken along the line D—D of FIG. 12.

FIGS. 12 and 13 illustrate another embodiment of the present invention. The example shown in these drawings includes a clutch bar engaging groove 13 in the inner surface of the outer cylinder 1 formed with a rectangular cross section and the actuating portion 31 formed on the side of corresponding clutch bar 3 in a shape conforming thereto. The clutch bar 3 is biased toward the discs 4 by springs 62 interposed between the end retainers 6. Thus by the alignment of the recesses 43 of each disc 4, the actuating portion 32 of the clutch bar 3 engages the recesses 43 by the spring force, thereby withdrawing the actuating portion 31 from the shear line.

Meanwhile, in each embodiment mentioned above, although the return spring 7 connected to the discs 4 is formed by bending a plate spring, it is not limited thereto, for example, a spring wire bent in a U-shaped configuration may be engaged with each disc.

In the locked condition as shown in FIGS. 1 and 2, the clutch bar 3 is engage to the clutch bar engaging groove 13 in the outer cylinder 1 at the actuating portion 31 thereof and retained in this state biased by the springs 62. When the key 8 is inserted into the key holes 16 and 41 on unlocking, each disc 4 is displaced against the force of the spring 7 and as the key 8 is inserted to the fixed position, the inclined projections 42 on the corner portion of the key hole coincide with the inclined notches 82 of the key piece 81. At this time the recesses 43 of each disc 4 are aligned in the position opposing the actuating portion 32 of the clutch bar 3. In this state, if a rotating force is applied to the inner cylinder 2 including the clutch bar 3, which withdraws from the shear line against the force of the spring 62 by the displacement of its actuating portion 31 relative to the slope of the engaging groove 13. The actuating portion 32 engages the recesses 43 of the discs 4 to allow the inner cylinder 2 including the clutch bar 3 and the discs 4 to rotate, thereby actuating the dead bolt 25 to the unlocked position.

On relocking, by turning the key 8 reversely, the inner cylinder 2 including the clutch bar 3 and the discs 4 rotates integrally the same as previously described and the clutch bar 3 engages the clutch bar engaging grove 13 in the outer cylinder 1 to fix both cylinders together. In this state, if the key 8 is drawn out from the key hole, each disc 4 slides orthogonally to the clutch bar 3 by the pull-out of the inclined notches 82 against the projections 42 and the spring force of the return spring 7, thus causing the recesses 43 thereof to shift from the position aligned with the clutch bar 3.

Meanwhile, when the discs 4 are shifted relative to the clutch bar 3, the saw-tooth portions 45 of the discs 4 will engage actuating portion 32 and will be interrupted from descending. Thus as long as all the recesses 43 of a number of discs 4 are not in alignment, the shear line is not cut off, thereby improving the locking performance.

In the present invention, as described above, the projections 42 having depths and inclined angles conforming to the inclined notches 82 of the key 8 are formed on the corner of the key hole 41 of each disc 4, so that each disc 4 will not be moved by the set amount by far as the corresponding inclined notches 82 of the key 8 which are not in conformity with such set amount. Thus it is impossible to unlock illegally by means of a wire, a false key and the like. Besides, since the inner and outer cylinders are constructed to engage each other removably by the clutch bar 3, ample strength is obtained and there is no possibility to break the lock. In addition, since the corner portions of the key 8 are cut, it is difficult to duplicate another key. At present a machine capable of such machining is really not available in the market. Since the disc 4 is formed with a flat metal plate, the construction is so simple that the number of discs relative to the lock having a fixed length may be increased, and is efficacious in minimizing the lock size and increasing the key settings, thereby effectively achieving the expected objects.

Although the present invention has been described by its preferred embodiment, it is understood by those skilled in the art that various changes and modifications may be made within the scope not departing from the spirit of the present invention. The scope of the present invention is therefore to be determined solely by the appended claims.

What is claimed is:

1. A locking device to be locked and unlocked by a key comprising:

an outer cylinder having a clutch bar engaging groove disposed longitudinally along its inner surface;

an inner cylinder rotatably contained and arranged within the outer cylinder;

a clutch bar disposed between said outer and inner cylinders and having one side engageable with said engaging groove;

clutch bar spring means carried by said inner cylinder for biasing said clutch bar into engagement with said engaging groove; and a plurality of discs disposed within the inner cylinder and arranged reciprocally in the direction orthogonal to said clutch bar to regulate the movement of said clutch bar, wherein each disc includes:

a slit-shaped key hole;

each key hole having a projection having a depth and inclined angle, conforming to inclined notches of the key, formed on a corner portion of said key hole, each of said projections of each of said discs being required to conform to the inclined notches of the key in order to open the lock; and a first recess removably receiving the other side of said clutch bar, each disc also having a second recess engaged by a return spring to bias said disc in a direction in which said first recess is non-aligned with said clutch bar, each of said discs being capable of shifting by using said key to a position in which said first recess is aligned with said clutch bar such that said other side of said clutch bar moves into said first recess, against the bias of said clutch bar springs, to cause disengagement of said clutch bar from said clutch bar engaging groove of said outer cylinder so as to permit an unlocking of said locking device.

2. A locking device in accordance with claim 1, wherein said outer cylinder includes a clutch bar engaging groove having a rectangular cross section, said clutch bar includes a V-shaped actuating portion engageable with said clutch bar engaging groove.

3. A locking device in accordance with claim 1, wherein said outer cylinder includes a clutch bar engaging groove having a rectangular cross section, said clutch bar includes a rectangular actuating portion engageable with said clutch bar engaging groove.

4. A locking device in accordance with claim 1, wherein said outer cylinder includes a face plate having a circular hole, and a guard plate having a boss engaged with said face plate.

5. A locking device in accordance with claim 1, wherein said inner cylinder includes;

a disc mounting portion having openings extending in a diametrical direction for slidably receiving said discs; and a clutch bar engaging portion communicating orthogonally with said disc opening and conforming to the width of said clutch bar engaging groove.

6. A locking device in accordance with claim 1, wherein said each disc comprises a stamped metal plate.

7. A locking device in accordance with claim 1, wherein said return spring is constituted by a plurality of spring sections formed in a series to engage each disc, said return spring having a U-shaped construction an having a plurality of channels between said spring sections.

* * * * *